US007234583B2

(12) United States Patent
Illedits et al.

(10) Patent No.: US 7,234,583 B2
(45) Date of Patent: Jun. 26, 2007

(54) ESCALATOR OR MOVING WALK

(75) Inventors: Thomas Illedits, Neufeld (AT); Robert Ulrich, Bruckneudorf (AT); Hubert Hölzl, Reisenberg (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 11/264,632

(22) Filed: Nov. 1, 2005

(65) Prior Publication Data

US 2006/0096834 A1 May 11, 2006

(30) Foreign Application Priority Data

Nov. 8, 2004 (EP) ..... 04405682

(51) Int. Cl.
*B66B 23/00* (2006.01)

(52) U.S. Cl. ..... 198/324; 198/325

(58) Field of Classification Search ..... 198/323–325
See application file for complete search history.

(56) References Cited

U.S. PATENT DOCUMENTS

| | | | | |
|---|---|---|---|---|
| 3,132,733 | A * | 5/1964 | Boman et al. | 198/323 |
| 3,233,717 | A * | 2/1966 | Jin et al. | 198/323 |
| 3,913,723 | A | 10/1975 | Johnson | |
| 4,476,971 | A | 10/1984 | Schoneweiss | |
| 4,629,052 | A * | 12/1986 | Kitamura | 198/323 |
| 5,307,918 | A | 5/1994 | Rivera et al. | |
| 5,611,417 | A * | 3/1997 | Stawniak et al. | 198/323 |
| 5,628,391 | A * | 5/1997 | Volkening et al. | 198/325 |
| 5,908,104 | A * | 6/1999 | Brun-Jarret | 198/324 |
| 6,520,310 | B1 * | 2/2003 | Lauch et al. | 198/323 |
| 6,564,904 | B2 * | 5/2003 | Mueller et al. | 182/222 |
| 6,644,457 | B2 * | 11/2003 | Lauch | 198/322 |

FOREIGN PATENT DOCUMENTS

EP 0 716 039 A1 6/1996

* cited by examiner

*Primary Examiner*—Douglas Hess
(74) *Attorney, Agent, or Firm*—Schweitzer Cornman Gross & Bondell LLP

(57) ABSTRACT

An improved escalator or moving walk construction, head elements are pre-assembled as a sub-assembly which is subsequently mounted on the truss of the escalator. The sub-assembly includes comb plate holders, one on each side, which carry a comb plate. The comb plate holder may have a C-shaped profile and may be reinforced by stiffening ribs so as to be able to bear the weight of the end-curve of a balustrade. By means of supports arranged on the truss, the height of the comb plate carrier can be adjusted to that of the truss. During pre-assembly, and until after final mounting on the truss, the comb plate serves as a connecting element between comb plate holders.

6 Claims, 8 Drawing Sheets

ESCALATOR OR MOVING WALK

The invention relates to an escalator or moving walk with steps or pallets, a balustrade with handrail, and head elements arranged on a lower escalator head or moving-walk head and on an upper escalator head or moving-walk head, that are connected to a truss of the escalator or moving walk.

BACKGROUND OF THE INVENTION

Head elements such as, for example, comb plates, balustrade clips, skirt-panel fastening brackets, handrail return sheaves, finger-protection mechanisms, and the like of an escalator or moving walk are usually mounted on the escalator or moving walk truss, and are adjusted individually.

A disadvantage of such a known assembly procedure is that the truss must first be completely assembled before mounting of the head elements can be started, which results in a long process time for assembly of the complete escalator or moving walk.

The present invention proposes a solution for avoiding the disadvantages of the known construction and permitting the construction of an escalator or moving walk to be carried out in such a manner that assembly operations can be performed in parallel.

The invention combines head elements into a pre-assembled sub-assembly which can then be mounted on the escalator or moving walk head truss. The sub-assembly may include a pair of comb plate holders to support a comb plate.

The advantages achieved by the invention include that the process time for assembly of the complete escalator or moving walk can be substantially shortened. In addition, the head elements can be combined into a sub-assembly independent of mounting on the truss and adjusted in advance. The sub-assembly can then be mounted in one piece on the truss of the escalator or moving walk.

In the further description of a preferred, but nonetheless illustrative embodiment that follows, the invention is presented in relation to an escalator. However, the disclosure also applies analogously to a moving walk, wherein escalator steps 9.1 correspond to moving walk pallets. The listing of the head elements is not exhaustive.

BRIEF DESCRIPTION OF THE DRAWINGS

The present invention is explained in more detail by reference to the attached figures, wherein.

DETAILED DESCRIPTION OF THE INVENTION

Figure 1:
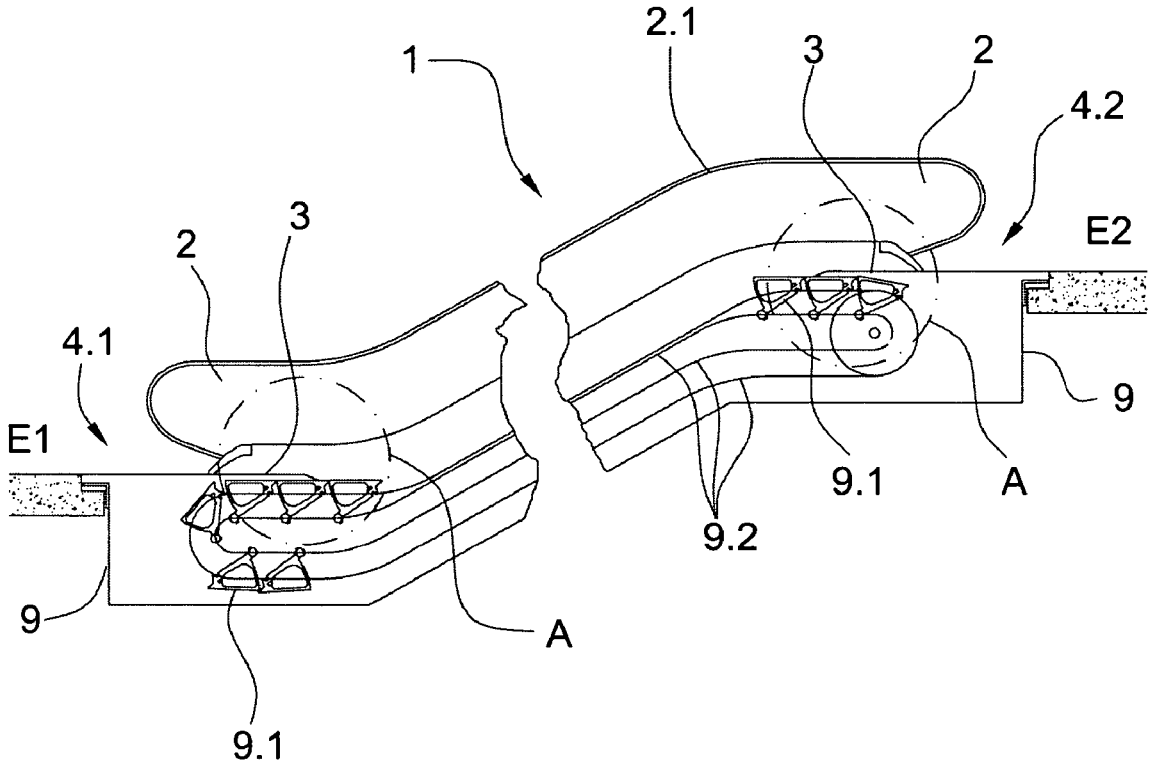
FIG. 1 is a diagrammatic elevation view of an escalator with a balustrade, a truss, and subassemblies according to the invention arranged at the lower and upper ends of the escalator.

FIG. 1 shows an escalator 1 with a glass balustrade 2 with handrail 2.1 and, arranged on the lower escalator head 4.1 and on the upper escalator head 4.2, subassemblies 3, each of which comprises individual escalator-head elements and is fastened to the truss 9. The escalator 1 connects a lower floor E1 to an upper floor E2, the steps 9.1 being moved along guides 9.2 of the truss 9.

Figure 2:
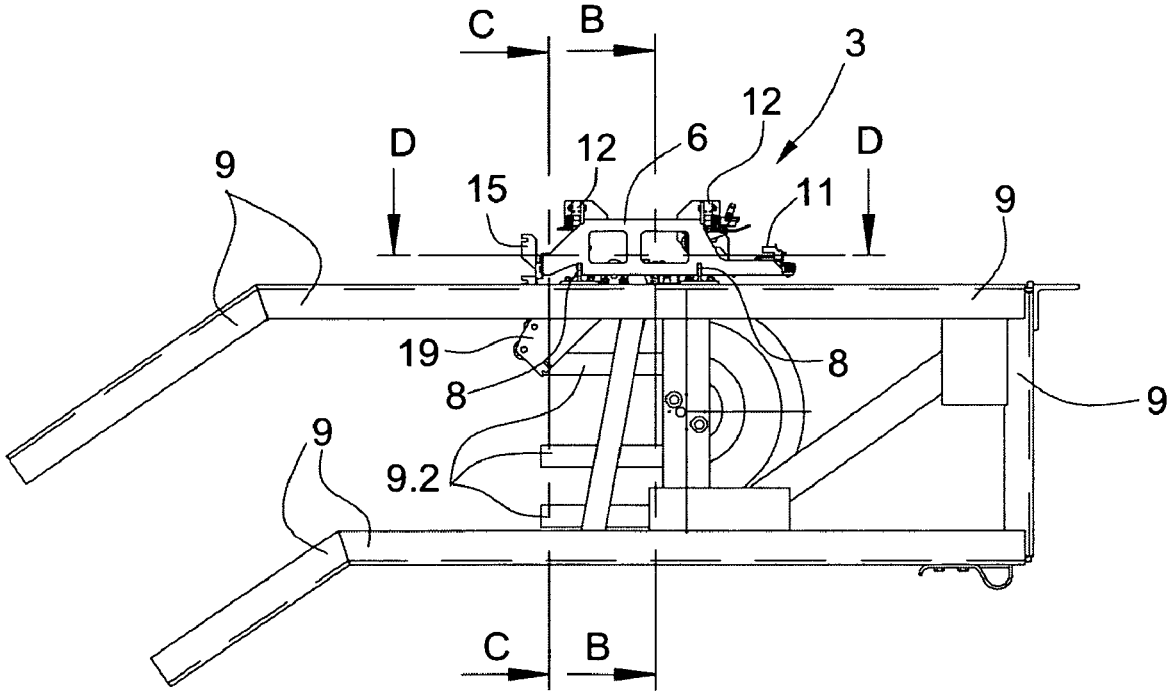
FIG. 2 is a detail view of cutout "A" of FIG. 1 at the upper end of the escalator.
Figure 3:
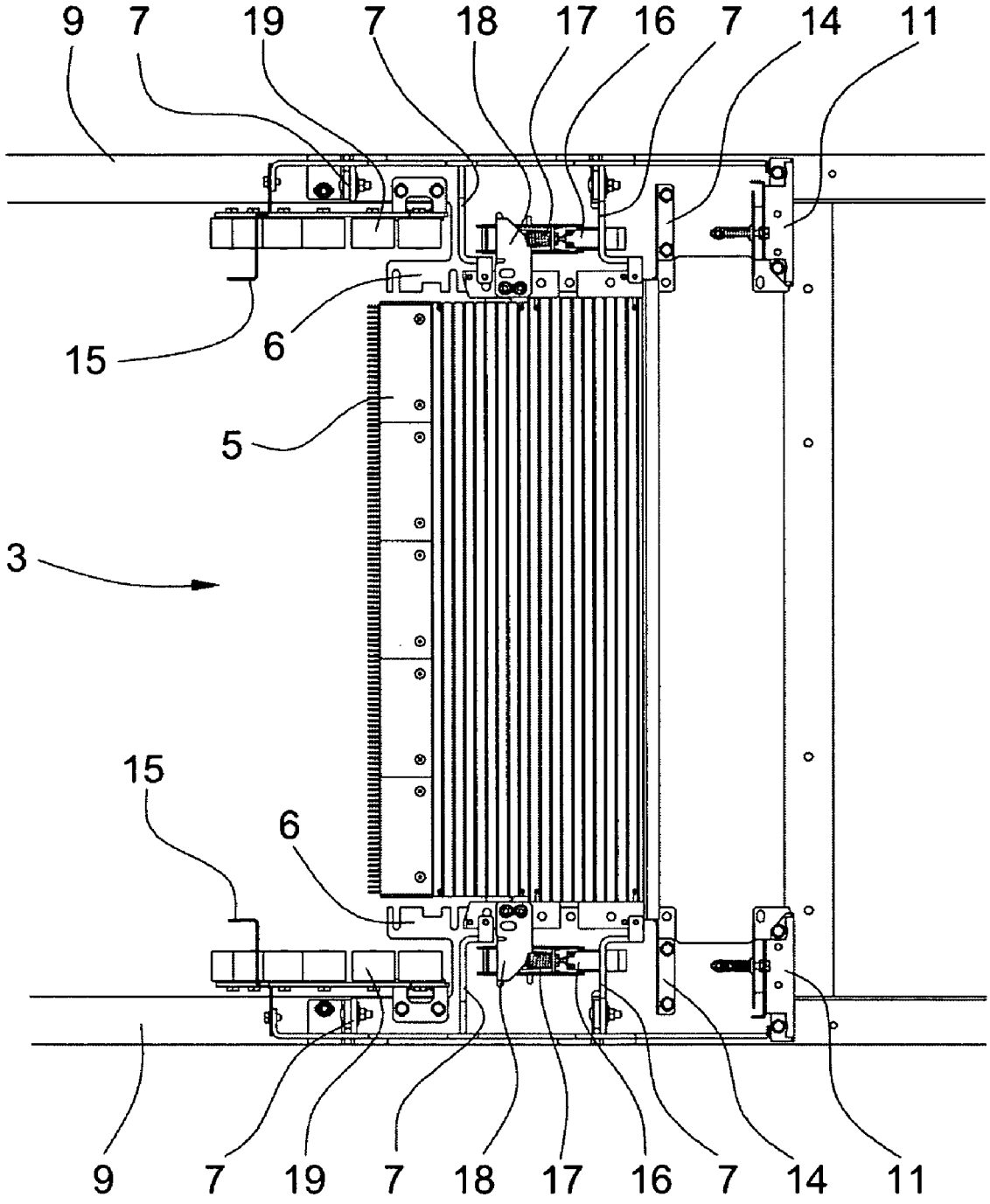
FIG. 3 is a cross section view taken along the line D—D shown in FIG. 2.
Figure 4:
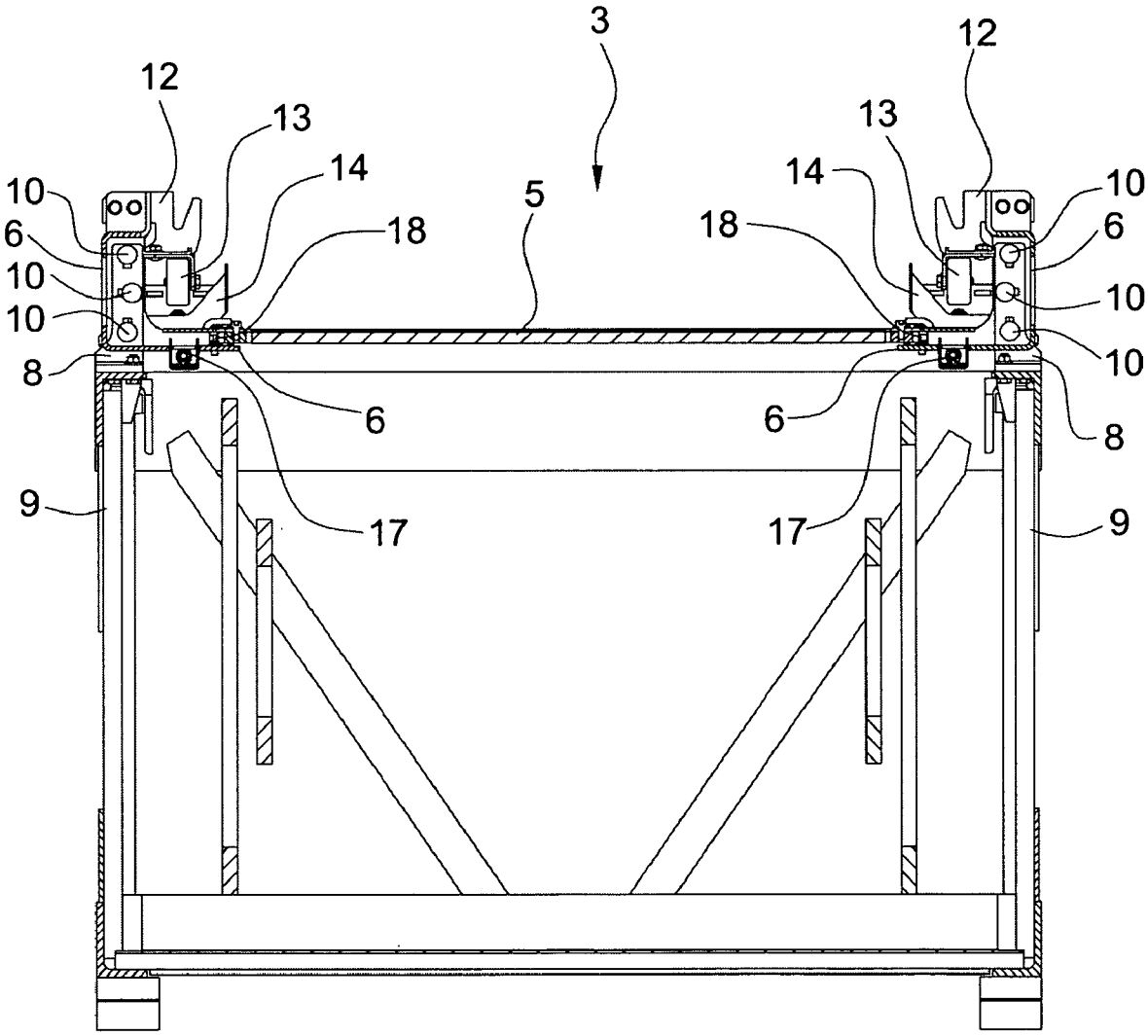
FIG. 4 is a cross section view taken along the line B—B shown in FIG. 2.
Figure 5:
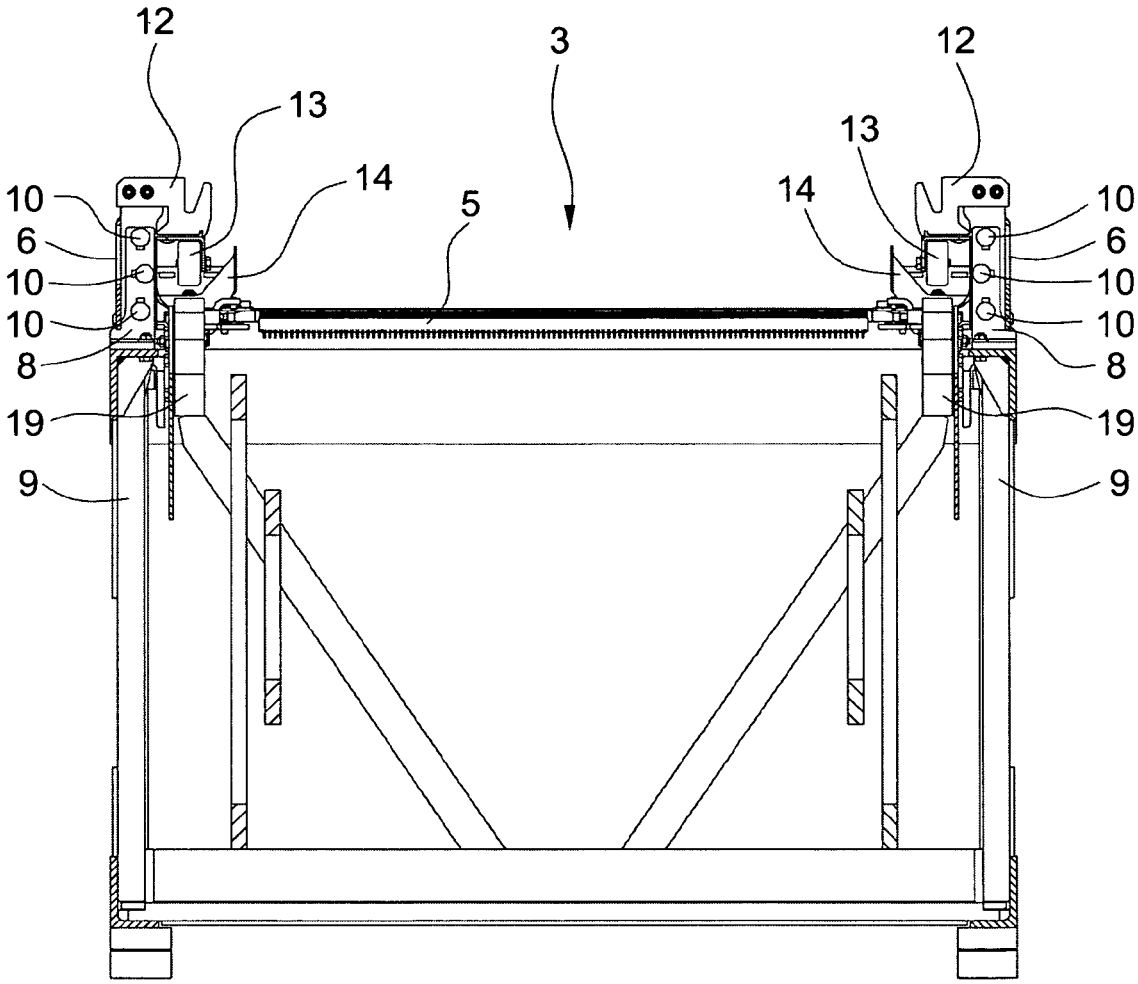
FIG. 5 is a cross section view taken along the line C—C shown in FIG. 2.

FIG. 2 details the cutout A of the upper escalator head 4.2 of the escalator 1. FIG. 2 also shows the positions of the cross sections B—B, C—C, and D—D, which are illustrated in FIGS. 4, 5 and 3, respectively.

As seen, the subassembly 3 essentially includes a comb-plate holder or carrier 6 on each side, which together carry a comb plate 5. Each comb-plate carrier has a C-shaped profile and is reinforced by stiffening ribs 7 so as to bear the weight of the end-curve of the glass balustrade 2. The stiffening ribs 7 are, for example, welded to the comb-plate carrier 6. By means of supports 8 arranged on the truss 9, the height of the comb-plate carrier 6 can be adjusted with respect to the truss 9. This adjustment of height is effected by means of, for example, screws, rivets, or welded studs 10. Welding after the adjustment of height is also possible. The supports 8 are bolted or welded to the truss 9 and their width adjusted to that of the truss 9 by means of a gauge.

Arranged on the front side of the comb-plate carrier 6, which forms the basic element of the subassembly 3, is a finger-protection contact mechanism 11. Bolted onto the finger-protection contact mechanism 11 are a handrail entry cover plate and the faceplates of the handrail entry as known which together form a left or right handrail-entry subassembly.

Arranged on the upper side of each comb-plate carrier 6, more precisely on the upper bending surface of the C-profile of the comb-plate carrier 6, are two balustrade clips 12. The balustrade clips 12 bear the end-curves of the balustrade 2. The front balustrade clip 12 additionally bears a handrail guide roller 13. In addition, bolted onto the front side of the comb-plate carrier 6 behind the finger-protection contact mechanism 11 is a skirt-panel fastening bracket 14 by means of which an end piece of the skirt panels can be correctly positioned relative to the comb plate 5. In addition, bolted onto the rear side of the comb-plate carrier 6, behind the second support 8, is a further skirt-panel fastening bracket 15 by means of which the end piece of the skirt panels can be positioned accurately to the millimeter relative to the comb plate 5. In the central section of the comb-plate carrier 6, behind the first support 8, more precisely behind the first stiffening rib 7, is a device for monitoring the horizontal position of the comb plate 5, the device having a comb-plate switch 16, an actuating spring 17, and a stop bracket 18.

When an object becomes jammed between the moving steps 9.1 and the comb plate 5, on a resulting horizontal displacement of the comb plate 5 at least one of the comb-plate switchs 16 is actuated and stops operation of the escalator 1. The actuating spring 17 acts with its spring force against the moving comb plate 5 and normally holds the comb plate 5 in its starting position. The stop bracket 18 is connected to the comb plate 5 and serves as opposing support for the actuating spring 17.

Arranged on the rear side of the comb-plate carrier 6, behind the second stiffening rib 7 and in front of the third stiffening rib 7, and more precisely in front of the second support 8, is a handrail return-sheave curve 19 which guides the handrail 2.1 downward to the handrail driving wheel.

The handrail return-sheave curve 19 must form a common line, or be flush, with the handrail guide roller 13.

Figure 6:
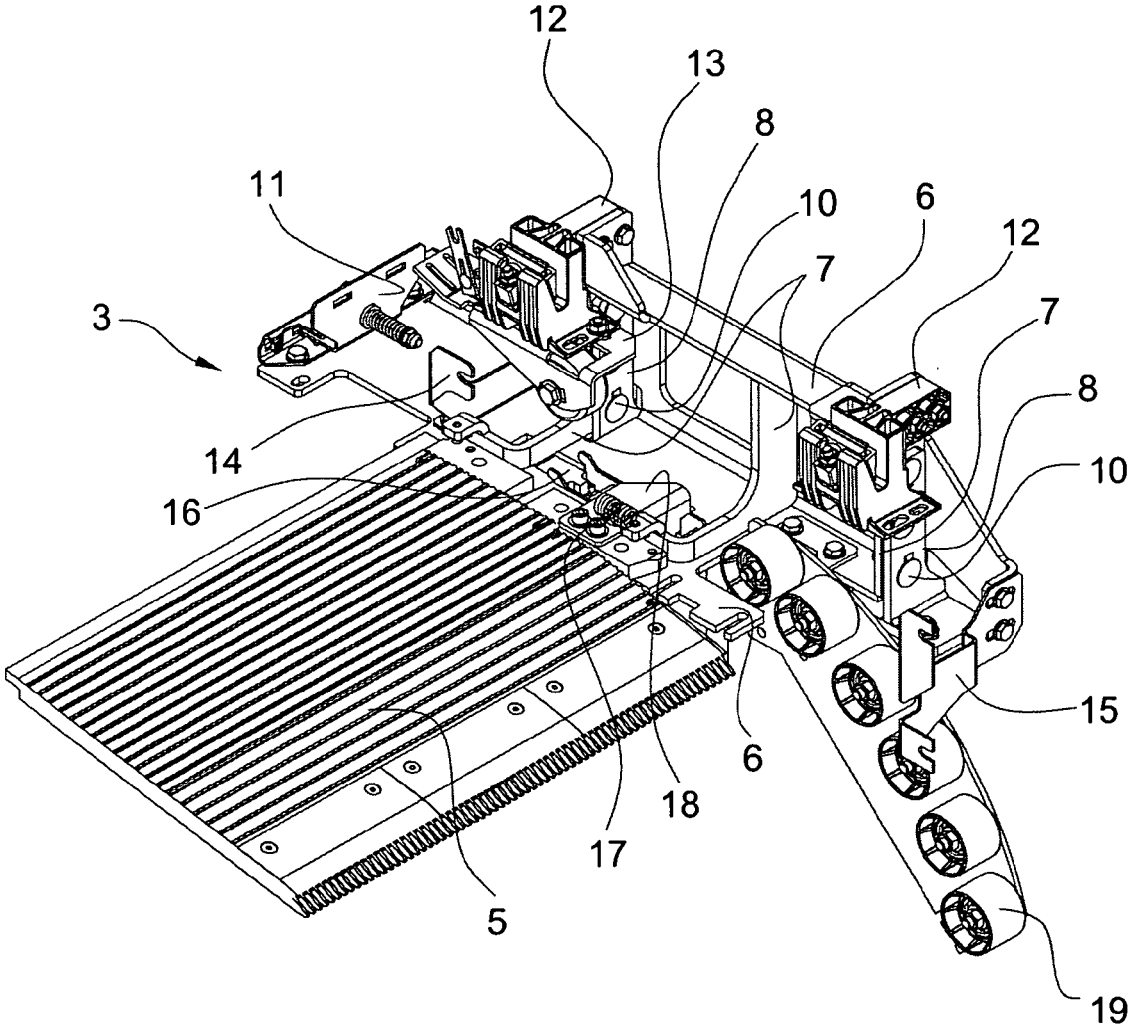
FIG. 6 is a prospective view of one half of the sub-assembly according to the invention.
Figure 7:
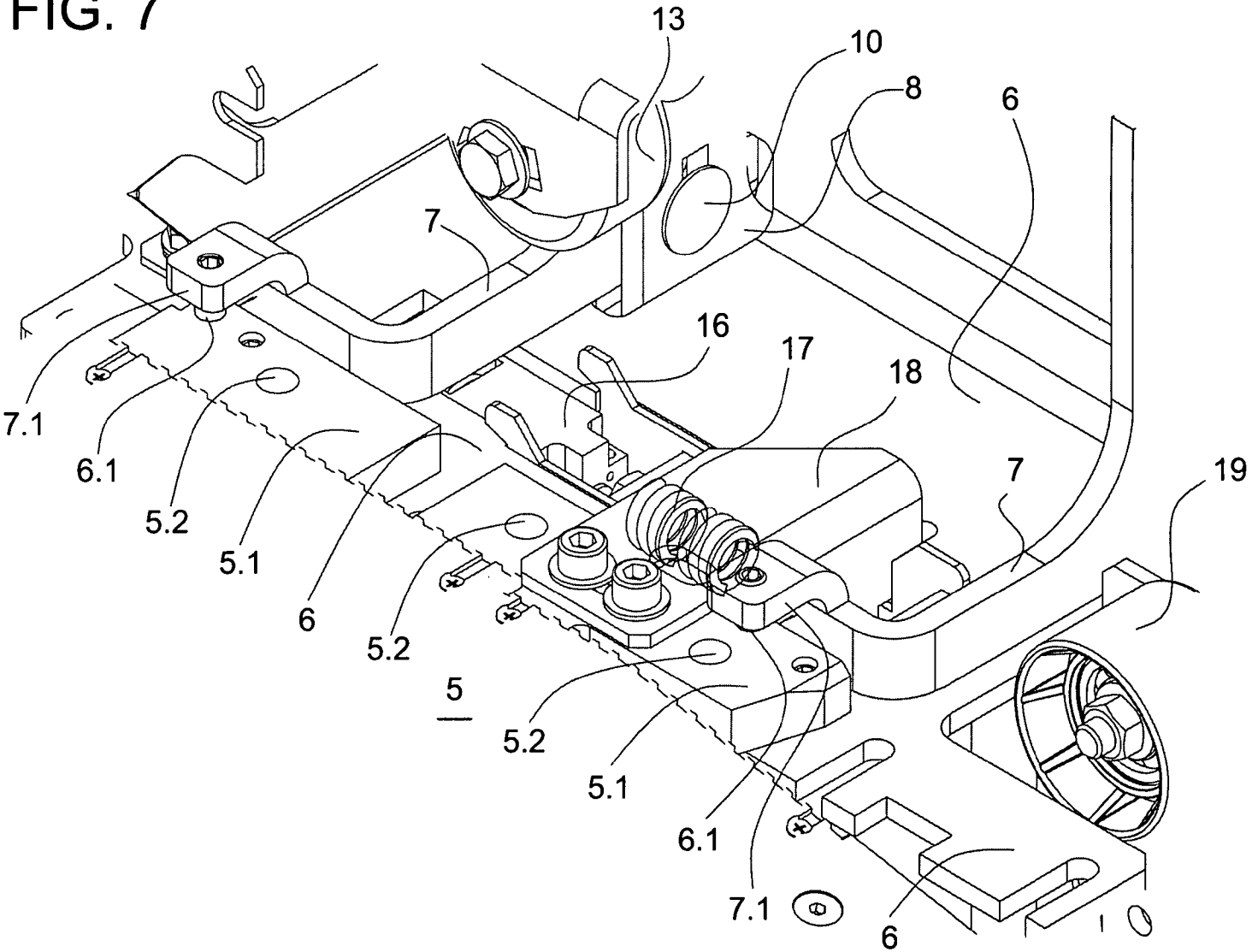
FIG. 7 is a detail view of the sub-assembly.

FIG. 6 and FIG. 7 show one half of the subassembly 3 completely assembled and mounted on the truss 9. The subassembly 3 with all head elements is pre-assembled and adjusted in one piece and mounted complete on the truss 9 of the escalator 1. When the escalator 1 is subsequently assembled at the factory, the comb plate 5 is correctly adjusted relative to the tracks 9.2 and steps 9.1 and thus finally positioned.

During pre-assembly, and until after final mounting on the truss 9, the comb plate 5 serves as a connecting element between the two comb-plate carriers 6. The comb plate 5 includes cantilevers 5.1, having drilled holes 5.2 through which screws (not-shown) connect the cantilevers 5.1 to the comb-plate carrier 6. After final mounting on the truss 9, the screws are removed, the cantilevers 5.1 being capable of sliding horizontally on the comb-plate carrier 6. In the vertical direction, however, movement of the cantilevers 5.1 is limited by means of threaded pins 6.1, the threaded pins being arranged on tie-downs 7.1 of the stiffening ribs 7 and allowing adjustment of the allowable vertical movement of the comb plate.

By means of the tie-downs 7.1, which are integrated in the stiffening rib 7, the comb plate 5 is limited in its vertical movement. The horizontal sliding of the comb plate 5 is not hindered or limited by the tie-downs 7.1. Instead of the tie-downs 7.1, a continuous or temporary guidance of the comb plate 5 on the cantilevers 5.1 is possible. Mounted on the stiffening ribs 7 for this purpose are guides or counter-guides that hinder and/or limit the comb plate 5 in its vertical movement.

Figure 8:
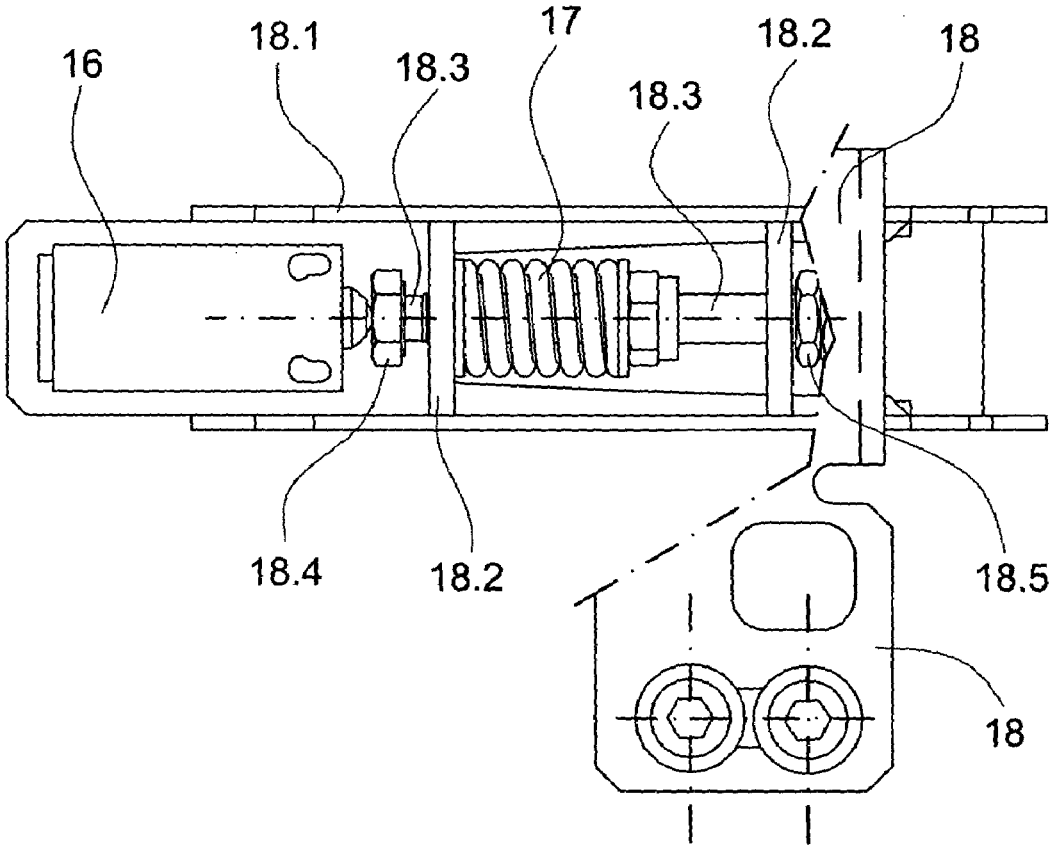
FIG. 8 is a plan view of a device for monitoring a comb plate.

FIG. 8 shows the device for monitoring the comb plate 5. Retaining plates 18.2 arranged in a housing 18.1 support a pin 18.3 which is capable of displacement along its longitudinal axis. One end of the pin 18.3 can be actuated by means of the stop bracket 18. By means of pin head 18.4 the other end of the pin 18.3 engages and actuates the comb plate switch 16. The pin 18.3 passes through the actuating spring 17, one end of actuating spring 17 resting against the retaining plate 17; the other end being connected to the pin 18.3. The stroke of the pin 18.3 is limited by a stop nut 18.5. The actuating spring 17 acts with its spring force against the comb plate 5 when set in motion. As shown in FIG. 8, the comb plate 5 has actuated the pin 18.3 by means of the stop bracket 18, which in turn, by means of the pin head 18.4, has actuated the comb-plate switch 16.

We claim:

1. In an escalator or moving walk of the type having steps or pallets, a balustrade with a handrail, and head elements that are arranged on at least one of a lower head and an upper head and are fastened to a truss of the escalator or moving walk, the improvement comprising a sub-assembly formed from the head elements associated with one of upper and lower heads, the sub-assembly being pre-assembled and mounted in an assembled condition on the truss of the escalator head or moving-walk head and comprising a comb plate releasably immovably mounted to a pair of opposed comb plate carriers by removable mounting means, the comb plate being movably arranged on the comb plate carriers when the mounting means are removed upon installation.

2. The improvement according to claim 1, wherein the sub-assembly further comprises a pair of cantilevers mounted to the comb plate through which the removable mounting means extend, the comb-plate carriers having means for limiting and adjusting allowable vertical travel of the cantilevers and thus the comb plate.

3. The improvement according to claim 1 or 2, further comprising supports arranged on the truss for adjusting the height of the comb plate carriers with respect to the truss.

4. The improvement according to claim 2, wherein a comb plate switch is arranged on a comb plate carrier for monitoring horizontal displacement of the comb plate.

5. The improvement according to claim 2 or 4, wherein at least one finger-protection contact mechanism, balustrade clips, a handrail guide roller, skirt-panel fastening brackets, and a handrail return-sheave curve are mounted to a side of a comb plate carrier.

6. The improvement according to claim 2, wherein the comb plate serves as a fastening element between the comb-plate carriers during pre-assembly and until after final mounting of the sub-assembly on the truss.

* * * * *